US007074100B2

(12) United States Patent
Ito et al.

(10) Patent No.: US 7,074,100 B2
(45) Date of Patent: Jul. 11, 2006

(54) METHOD OF FORMING METAL BACK-ATTACHED FLUORESCENT SURFACE AND IMAGE DISPLAY UNIT

(75) Inventors: Takeo Ito, Kumagaya (JP); Takashi Nishimura, Fukaya (JP); Tsuyoshi Oyaizu, Fukaya (JP); Hajime Tanaka, Fujioka (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 227 days.

(21) Appl. No.: 10/477,105

(22) PCT Filed: May 9, 2002

(86) PCT No.: PCT/JP02/04506

§ 371 (c)(1),
(2), (4) Date: Nov. 10, 2003

(87) PCT Pub. No.: WO02/093607

PCT Pub. Date: Nov. 21, 2002

(65) Prior Publication Data

US 2004/0170862 A1 Sep. 2, 2004

(30) Foreign Application Priority Data

May 10, 2001 (JP) ..... 2001-140284

(51) Int. Cl.
*H01J 9/00* (2006.01)
*H01J 9/24* (2006.01)

(52) U.S. Cl. ..... 445/24; 313/461; 313/479; 427/68; 445/58

(58) Field of Classification Search ..... 313/461
See application file for complete search history.

(56) References Cited

U.S. PATENT DOCUMENTS

| | | | | |
|---|---|---|---|---|
| 4,590,092 | A * | 5/1986 | Giancaterini et al. | 427/68 |
| 5,556,664 | A * | 9/1996 | Sasa et al. | 427/64 |
| 6,833,663 | B1 | 12/2004 | Tanaka et al. | 313/473 |
| 2004/0178718 | A1 | 9/2004 | Ito et al. | 313/496 |

FOREIGN PATENT DOCUMENTS

| | | |
|---|---|---|
| JP | 88497/1988 | 6/1988 |
| JP | 54360/1989 | 4/1989 |
| JP | 7-4959 | 2/1995 |
| JP | 2000-251797 | 9/2000 |
| JP | 2000-311642 | 11/2000 |
| JP | 2000-326583 | 11/2000 |
| WO | WO 2005081281 A1 * | 9/2005 |

* cited by examiner

*Primary Examiner*—Nimeshkumar D. Patel
*Assistant Examiner*—Natalie K. Walford
(74) *Attorney, Agent, or Firm*—Oblon, Spivak, McClelland, Maier & Neustadt, P.C.

(57) ABSTRACT

A method for forming a metal back-attached phosphor screen comprises the step of dissolving/removing or rendering highly resistant a specified area of a metal film formed on a phosphor screen by using a liquid that dissolves or oxidizes the metal film. After part of a metal film is removed or rendered highly resistant, an insulating or highly resistant inorganic material may be applied to the remaining ends thereof. Alternatively, an insulating or highly-resistant inorganic material may be added to a dissolving or oxidizing liquid to dissolve/remove or render highly resistant a metal film, and at the same time ends of the metal film are coated with the inorganic material. In this metal back-attached phosphor screen, electron emission elements and the phosphor screen are protected against destruction/deterioration by discharging.

15 Claims, 4 Drawing Sheets

METHOD OF FORMING METAL BACK-ATTACHED FLUORESCENT SURFACE AND IMAGE DISPLAY UNIT

TECHNICAL FIELD

The present invention relates to a method for forming a metal back-attached phosphor screen and an image display unit having the metal back-attached phosphor screen.

BACKGROUND ART

For a conventional image display unit such as a cathode-ray tube (CRT) or a field emission display (FED), a metal back-attached phosphor screen which has a metal film formed on the inner surface (surface opposite to the face plate) of a phosphor layer has been used extensively.

Such a metal film is called the metal back layer and it reflects light advancing to an electronic source, which is in light emitted from a phosphor material by electrons emitted from the electronic source, toward the face plate to enhance brightness and also serves to stabilize the potential of the phosphor layer as an anode electrode. And, the metal back also has a function to prevent the phosphor layer from being damaged by ions which are generated when gas remaining in a vacuum envelope is ionized.

Particularly, the FED had a disadvantage that an electric discharge (vacuum arc discharge) occurred easily when images were formed for a long period because there was a small gap (space) of approximately one to several millimeters between the face plate having a phosphor screen and a rear plate having electron emission elements, and a high voltage of approximately 10 kV was applied to the very small gap to form a high electric field.

And, when such an abnormal electric discharge occurred, a large discharge current in a range of several amperes to several hundred amperes flowed instantaneously, so that there was a possibility that electron emission elements of a cathode section and a phosphor screen of an anode section were destructed or damaged.

In order to ease a damage in case of the occurrence of an abnormal electric discharge, there is proposed an image display having a metal back layer (an anode electrode) in which gaps are formed in a zigzag form (meandering form) or a spiral form (coil form) in Japanese Patent Laid-Open Applications No. 2000-311642, No. 2000-251797, No. 2000-326583, etc. And, there is proposed a method of cutting with laser or vapor deposition with a metal mask for fabricating and forming the anode electrode into a zigzag form or the like.

But, the image display had disadvantages that it required an expensive and large-scale device such as a laser generator in order to cut and fabricate the anode electrode and that an effect of preventing an electric discharge from occurring between the anode section and the cathode section was insufficient.

The present invention has been made to remedy the above-mentioned disadvantages and provides a method for forming a metal back-attached phosphor screen which prevents electron emission elements and a phosphor screen from being destructed or deteriorated by an electric discharge and an image display unit capable of making highly bright and high quality display without having the deterioration of brightness.

SUMMERY OF THE INVENTION

A method for forming a metal back-attached phosphor screen of the present invention comprises forming a phosphor screen, which has a light absorption layer and a phosphor layer both arranged in prescribed patterns, on an inner surface of a face plate, forming a metal film on the phosphor screen, and removing or rendering highly resistant a prescribed area of the metal film with a liquid that dissolves or oxidizes the metal film.

The image display unit of the invention comprises the metal back-attached phosphor screen, which is formed by the above-described method for forming a metal back-attached phosphor screen.

Another aspect of the image display unit according to the invention comprises an envelop having a face plate and a rear plate which is disposed to oppose the face plate, multiple electron emission elements formed on the rear plate, and a phosphor screen formed on the face plate to oppose the rear plate so to emit light by an electron beam emitted from the electron emission elements, wherein the phosphor screen is the metal back-attached phosphor screen formed by the aforesaid method for forming a metal back-attached phosphor screen.

In the method for forming a metal back-attached phosphor screen of the invention, at least part of an area of the metal film located on the light absorption layer may be coated with the liquid that dissolves or oxidizes the metal film. And, the liquid that dissolves or oxidizes the metal film may be an acid liquid of pH 5.5 or below or an alkali liquid of pH 9 or higher.

And, an insulating or highly resistant inorganic material having a binding property may be applied to the remaining ends of the metal film after the metal film is partly removed or rendered highly resistant. Besides, a mixed liquid which is prepared by adding an insulating or highly-resistant inorganic material having a binding property to an acid liquid of pH 5.5 or below or an alkali liquid of pH 9 or higher may be used as the liquid that dissolves or oxidizes the metal film, the part of the metal film to which the mixed liquid is applied may be removed or rendered highly resistant and at the same time, the remaining ends of the metal film may be coated with the inorganic material.

A prescribed region of the metal film formed on the phosphor screen is treated with a liquid that dissolves or oxidizes the metal film, and the metal film of the portion treated with the liquid is dissolved and removed or transformed into an oxide having a high electric resistance value. As a result, in the image display unit having the metal film as the anode electrode, an electric discharge is prevented from being generated and, if an electric discharge is generated, the peak value of discharge current is suppressed. Because the maximum value of energy emitted at the time of electric discharge is reduced, the electron emission elements and the phosphor screen are prevented from being destructed/damaged or deteriorated.

BEST MODE FOR CARRYING OUT THE INVENTION

Figure 1:
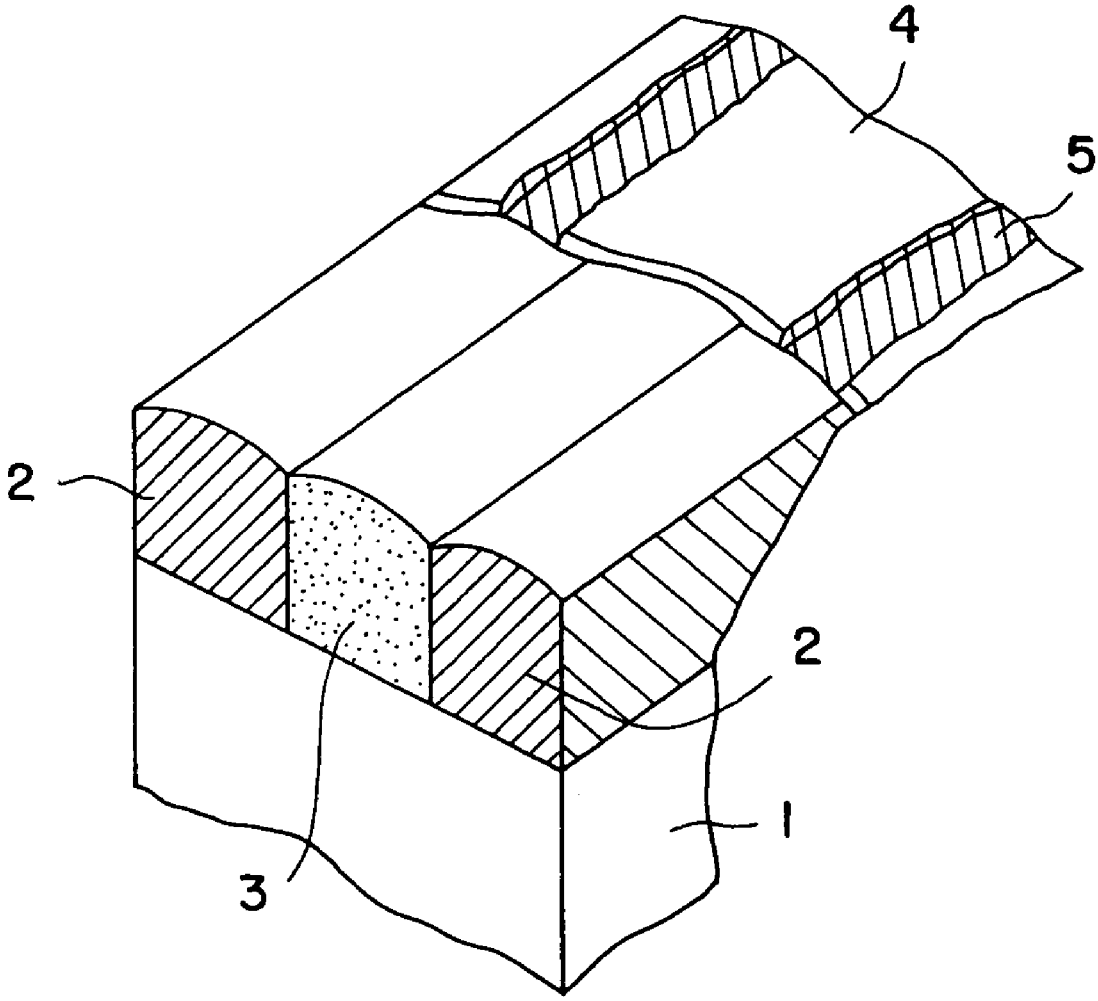
FIG. 1 is a diagram schematically showing a structure of the metal back-attached phosphor screen formed in a first embodiment of the invention.

Embodiments of the invention will be described. It is to be understood that the present invention is not limited to the following embodiments.

In the first embodiment of the invention, after a light absorption layer of a black pigment having a predetermined pattern (e.g., a stripe pattern) is formed on the inner surface of a face plate by photolithography, ZnS-based, $Y_2O_3$-based or $Y_2O_2S$-based phosphor material liquid is applied to the aforesaid layer by a slurry method or the like and dried, and patterning is conducted by photolithography to form a three color phosphor layer of red (R), green (G) and blue (B). The phosphor layer of the individual colors may be formed by a spray method or a printing method. The spray method or the printing method can also be used together with the patterning according to photolithography if necessary.

Then, a metal back layer is formed on the phosphor screen formed as described above. For example, to form the metal back layer, there can be adopted a method by which a metal film of aluminum (Al) or the like is formed by vacuum deposition on a thin film of an organic resin such as nitrocellulose formed by a spin method, and organic substances are removed by baking. The metal back layer can also be formed by using a transfer film as descried below.

The transfer film has a structure in that a metal film of Al or the like and an adhesive agent layer are superposed sequentially on a base film via a parting agent layer (a protective film, if necessary). This transfer film is disposed so to contact the adhesive agent layer with the phosphor layer and pressurized. A stamp method, a roller method or the like is available as a pressing method. Thus, the transfer film is pressed to adhere the metal film, and the base film is peeled so as to transfer the metal film to the phosphor screen.

Then, a liquid that dissolves or oxidizes the metal film (hereinafter referred to as a dissolving or oxidizing liquid) is applied to a prescribed area of the metal back layer (a metal film) to dissolve and remove the metal film to which the liquid is applied or to transform into an oxide having an electric resistance higher than the metal.

Here, it is desired that the area of the metal film to which the dissolving or oxidizing liquid is applied is at least a part of the area positioned on the light absorption layer of the lower layer's phosphor screen. By configuring in that way, an influence due to reduction in brightness caused by reduction in reflectance can be minimized even if metal's inherent reflectance is lost from the portion by dissolving or rendering highly resistant the metal film.

The dissolving or oxidizing liquid can be an acid liquid of pH 5.5 or below or an alkali liquid of pH 9 or higher. As the acid liquid, an aqueous solution of phosphoric acid, oxalic acid or the like is used, and as the alkali liquid, an aqueous solution of sodium hydroxide, potassium hydroxide, sodium carbonate or the like is used.

As a method of applying such a liquid, an ink-jet type coating method or a method of coating by spraying using a mask with openings can be used.

After the dissolving or oxidizing liquid is coated as described above, heating to a temperature of approximately 450° C. is conducted to remove or to transform into a highly resistant oxide at least part of the area of metal back layer (a metal film) corresponding to the light absorption layer. The dissolving or oxidizing liquid can also be coated after the organic material is removed by the heating treatment, and it is desirable to use a weakly acidic liquid or a weakly basic liquid.

The metal back-attached phosphor screen obtained as described above is shown in FIG. 1. In the drawing, reference numeral 1 denotes a glass substrate (face plate), 2 denotes a light absorption layer (light-shielding layer), 3 denotes a phosphor layer, 4 denotes a metal film (metal back layer) such as an Al film, 5 denotes a dissolved/removed portion of the metal film or a high resistant portion formed of a metal oxide.

Figure 2:
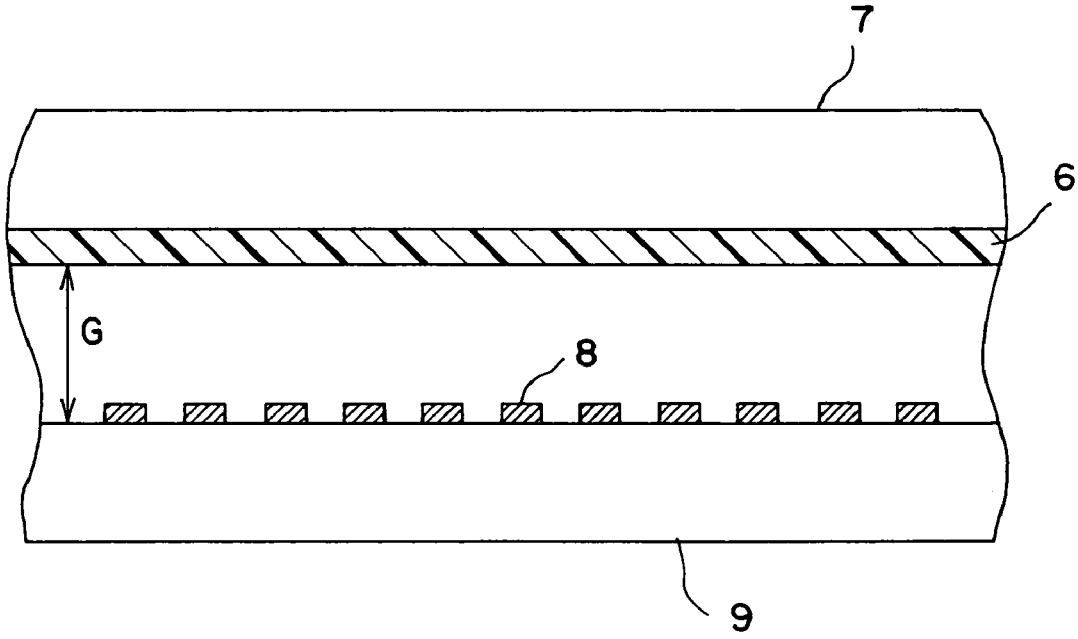
FIG. 2 is a sectional diagram showing a structure of an FED having the metal back-attached phosphor screen of the first embodiment as an anode electrode.

An FED having the metal back-attached phosphor screen as an anode electrode is shown in FIG. 2. This FED is configured so that a face plate 7 having a metal back-attached phosphor screen 6 and a rear plate 9 having electron emission elements 8 which are formed in matrix are disposed to oppose mutually with a small gap G of approximately one to several millimeters between them, and a high voltage of 5 to 15 kV is applied to the very small gap G between the face plate 7 and the rear plate 9.

Because the gap between the face plate 7 and the rear plate 9 is very small, an electric discharge (dielectric breakdown) occurs easily between them. But in the FED having the metal back-attached phosphor screen produced by the first embodiment of the invention, the occurrence of an abnormal electric discharge is suppressed, and the peak value of the discharge current when an electric discharge occurs is suppressed as indicated by (a) in FIG. 3, and a momentary concentration of energy can be avoided. And, when the maximum value of discharge energy is reduced, the electron emission elements and the phosphor screen are prevented from being destructed/damaged or deteriorated.

And, in the FED, the dissolved/removed portion of the metal film or the high resistant portion made of a metal oxide is limited to the area corresponding to the light absorption layer, so that the reflection effect of the metal back layer is hardly decreased. Therefore, substantial reduction in brightness does not occur.

Figure 3:
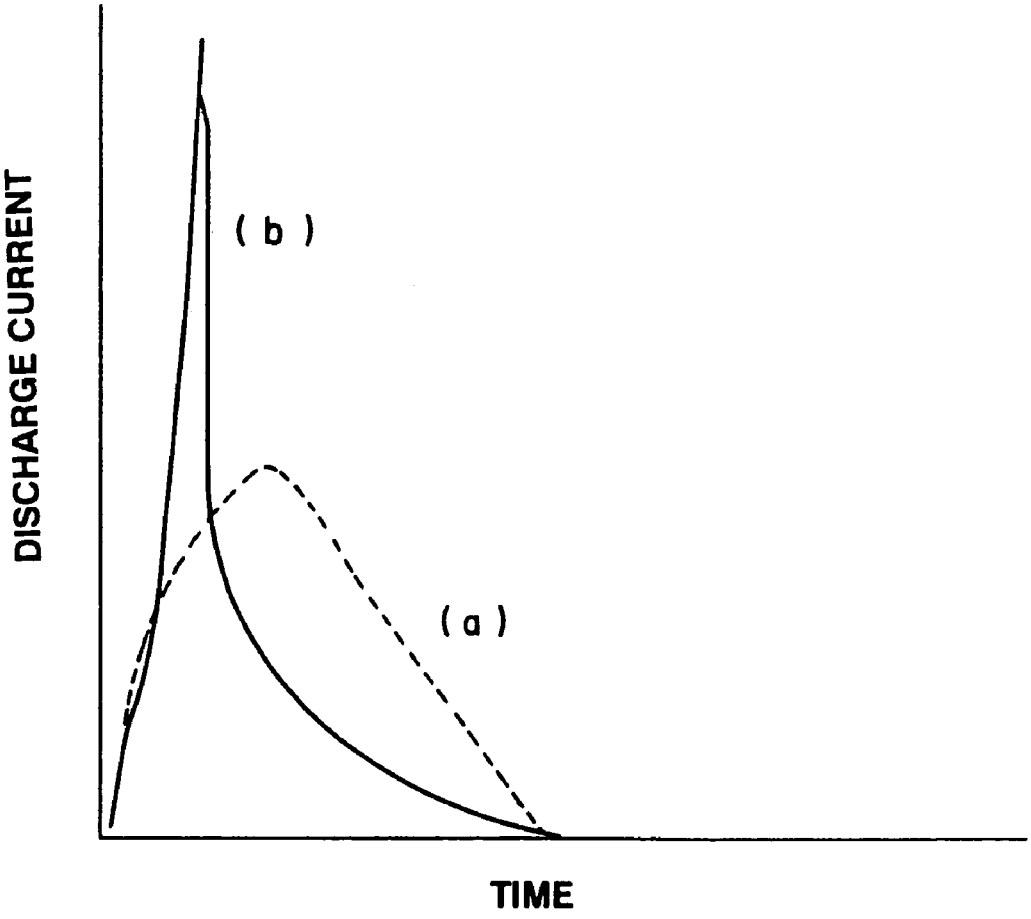
FIG. 3 is a graph showing a change in discharge current with time of the FED having the metal back-attached phosphor screen of the first embodiment.

A change in discharge current with time in a conventional FED is indicated by (b) in FIG. 3. A discharge current of the conventional FED has a large peak value, and the discharge energy concentrates at the moment when the electric discharge occurs, so that the electron emission elements and the phosphor layer (phosphor screen) are damaged easily.

Because the dissolving or oxidizing liquid is applied and the metal film is dissolved/removed or rendered highly resistant, boundary ends of the remained metal film with the removal portion or the high resistant portion have a sharp shape, e.g., a notched shape, on which an electric field concentrates easily. And, it happens that the electric field concentrates on the acute-angle portions to induce an electric discharge. In that case, a peak value of the discharge energy is reduced, but the number of electric discharge might increase instead.

To prevent such a disadvantage, a second embodiment of the invention applies a dissolving or oxidizing liquid to the metal back layer (metal film) to dissolve/remove the liquid applied portion of the metal film or transformed into a highly-resistant oxide, and then the remained ends of the metal film dissolved/removed or rendered highly resistant are coated with an insulating or highly-resistant inorganic material having a binding property.

As the insulating inorganic material having a binding property, flit glass, silica, alumina and the like are listed. As the inorganic material having higher resistance than the metal configuring the metal back layer, graphite, carbon black, conductive metal oxide and the like are listed. Such materials are applied by screen printing, spray coating or the like to coat the ends of the metal film remained as a result of the dissolving/removing or rendering highly resistant.

According to the second embodiment, an electric discharge by the localized concentration of an electric field is avoided, and a phosphor screen having an outstanding withstand voltage characteristic can be obtained. And, a withstand voltage characteristic of the metal back-attached phosphor screen is improved more stably, and the frequency of electric discharges is reduced considerably.

Besides, according to a third embodiment of the invention, a mixed liquid which is prepared by adding an insulating or highly-resistant inorganic material having a binding property to the dissolving or oxidizing liquid is used, the mixed liquid-applied portion of the metal film is dissolved/removed or rendered highly resistant, and at the same time, the ends of the remained metal film are coated with the insulating or highly-resistant inorganic material.

By the third embodiment, the metal back-attached phosphor screen having its withstand voltage characteristic improved more stably, and the occurrence of an electric discharge lowered considerably can be formed efficiently by a minimum number of steps.

Then, specific examples having the present invention applied to the image display unit (FED) will be described.

EXAMPLE 1

A light absorption layer (light-shielding layer) in a stripe shape of a black pigment was formed on a glass substrate by photolithography, and a three color phosphor layer of red (R), green (G) and blue (B) was patterned to have a stripe pattern and to be side by side between a light-shielding portion and a light-shielding portion by the photolithography. Thus, a phosphor screen was formed.

Then, a metal back layer was formed on the phosphor screen. Specifically, an organic resin solution mainly containing an acrylic resin was applied to the phosphor screen and dried to form an organic resin layer, on which an Al film was formed by vacuum deposition, then heating was conducted for baking at a temperature of 450° C. for 30 minutes to decompose and remove organic contents.

Subsequently, a solution of 5% of sodium hydroxide (NaOH) and the remainder of water was sprayed to the Al film by using a metal mask, which had openings in positions corresponding to the light absorption layer, with the substrate kept at a temperature of 50° C., and baking was conducted at a temperature of 450° C. for ten minutes.

By applying the solution and baking as described above, the solution applied portion of the Al film was oxidized to become a highly-resistant layer having a surface resistivity on the order of $10^{10}\Omega$/(square; the same is applied below). And, this high resistant Al oxide layer was formed to have a stripe pattern on the conductive Al film.

Then, a panel having the metal back-attached phosphor screen was used as a face plate to produce an FED by a common procedure. First, an electron generation source, which had a large number of surface conduction type electron emission elements formed in a matrix form on a substrate, was fixed to a rear glass substrate to produce a rear plate.

Figure 4:
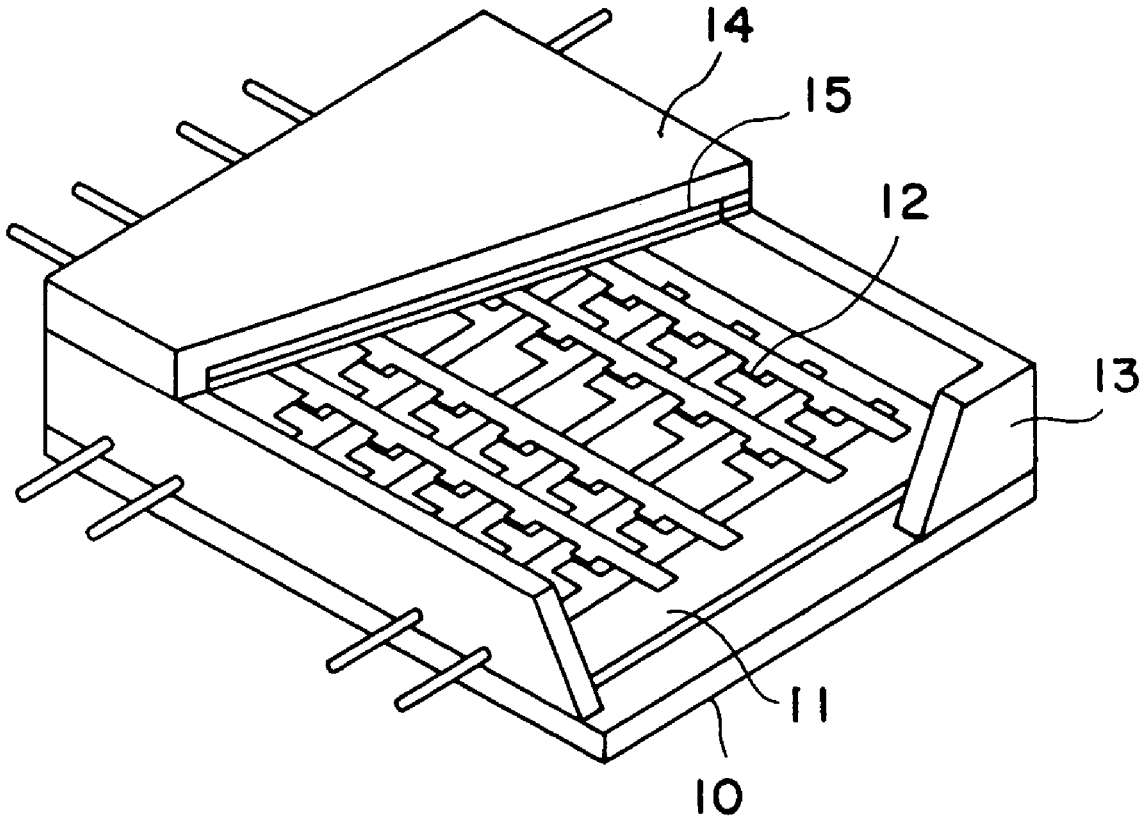
FIG. 4 is a perspective diagram showing a color FED provided with the metal back-attached phosphor screen formed by Example 1 of the invention.

The rear plate and the glass panel (face plate) were then disposed to oppose mutually through a support frame and a spacer and sealed with flit glass. At that time, the gap between the face plate and the rear plate was determined to be 2 mm. Then, required procedures such as evacuation, sealing and the like were conducted to complete the FED having the structure as shown in FIG. 4. In the drawing, reference numeral 10 denotes a rear plate, 11 denotes a substrate, 12 denotes surface conduction type electron emission elements, 13 denotes a support frame, 14 denotes a face plate, and 15 denotes a metal back-attached phosphor screen.

The FED obtained in Example 1 was measured for evaluation of its withstand pressure characteristic by a common procedure. A maximum voltage (maximum withstand voltage) not reaching an electric discharge was 10 kV in Example 1 while it was 8 kV in a conventional structure. And, the maximum value of occasional electric discharge energy due to fall-off particles was reduced to 20%, and damage to the electronic source and peeling of the phosphor film could be prevented.

EXAMPLE 2

After the Al film was formed on the phosphor screen in the same way as in Example 1, a treating solution consisting of 5% of NaOH, 1% of Na-based water glass and the remainder of water was applied to the Al film and baked in the same way as in Example 1.

By the application of the solution and baking as described above, the Al film of the applied portion was oxidized and became a highly resistant layer having a surface resistivity on the order of $10^{10}\Omega$/. And, this high resistant Al oxide layer having a stripe pattern was formed on the conductive Al film. It was confirmed by observing through a microscope that there was no curl at the ends (boundary portions with the Al oxide layer) of the Al film.

Then, a panel having the metal back-attached phosphor screen was used as a face plate to fabricate an FED in the same way as in Example 1.

The FED obtained in Example 2 was measured for evaluation of its withstand pressure characteristic by a common procedure. The maximum voltage (maximum withstand voltage) was 12 kV which was higher than that in Example 1. And, the maximum value of occasional electric discharge energy due to fall-off particles was improved to 20% in the same way as in Example 1, enabling to operate at a higher voltage, and there were obtained effects of preventing the electronic source from being damaged or the phosphor film from being peeled.

EXAMPLE 3

After the Al film was formed on the phosphor screen in the same way as in Example 1, an ink having the prescribed composition was printed on an area of the Al film on the light absorption layer, and baking was conducted at 450° C. for 30 minutes.

After the treatment, the Al film was measured its surface resistance to find that a portion where the ink was not printed had a surface resistivity of approximately 1Ω/, while the printed portion had a surface resistivity on the order of $10^{5}\Omega$/, and the coated portions of the Al film were dissolved/removed by ink printing and baking.

Then, a panel having such a metal back-attached phosphor screen was used as a face plate to fabricate an FED in the same way as in Example 1.

The FED produced in Example 3 was measured for evaluation of its withstand pressure characteristic by a common procedure. The maximum voltage (maximum withstand voltage) was improved to 15 kV higher than that in Example 1. And, the maximum value of occasional electric discharge energy due to fall-off particles was improved to 15% equal to or better than in Example 1, and an operation could be made at a higher voltage, and there were obtained effects of preventing the electronic source from being damaged or the phosphor film from being peeled.

INDUSTRIAL APPLICABILITY

As described above, the present invention retards the peak value of the discharge current, so that a metal back-attached phosphor screen having the electron emission elements and the phosphor screen prevented from being destructed or deteriorated is obtained. Therefore, the image display unit having the metal back-attached phosphor screen is improved its withstand voltage characteristic extensively, and high-definition display with high brightness can be realized without suffering from deterioration of brightness.

What is claimed is:

1. A method for forming a metal back-attached phosphor screen, comprising:

forming a phosphor screen, which has a light absorption layer and a phosphor layer both arranged in prescribed patterns, on an inner surface of a face plate;

forming a metal film on the phosphor screen; and applying a liquid that dissolves or oxidizes the metal film to a prescribed area of the metal film to dissolve and remove the metal film to which the liquid is applied or to transform into a metal oxide having a high electric resistance.

2. The method for forming a metal back-attached phosphor screen according to claim 1, wherein at least part of an area of the metal film located on the light absorption layer is coated with the liquid that dissolves or oxidizes the metal film.

3. The method for forming a metal back-attached phosphor screen according to claim 1, wherein the liquid that dissolves or oxidizes the metal film is an acid liquid of pH 5.5 or below or an alkali liquid of pH 9 or higher.

4. The method for forming a metal back-attached phosphor screen according to claim 1, wherein an insulating or highly resistant inorganic material having a binding property is applied to the remaining ends of the metal film after the metal film is partly removed or transformed into the metal oxide.

5. The method for forming a metal back-attached phosphor screen according to claim 1, wherein a mixed liquid which is prepared by adding an insulating or highly-resistant inorganic material having a binding property to an acid liquid of pH 5.5 or below or an alkali liquid of pH 9 or higher is used as the liquid that dissolves or oxidizes the metal film, the part of the metal film to which the mixed liquid is applied is removed or transformed into the metal oxide and at the same time, the remaining ends of the metal film are coated with the inorganic material.

6. An image display unit, comprising the metal back-attached phosphor screen, which is formed according to claim 1, on an inner surface of a face plate.

7. An image display unit comprising an envelop having a face plate and a rear plate which is disposed to oppose the face plate, multiple electron emission elements formed on the rear plate, and a phosphor screen formed on the face plate to oppose the rear plate so to emit light by an electron beam emitted from the electron emission elements, wherein the phosphor screen is the metal back-attached phosphor screen formed according to claim 1.

8. An image display unit, comprising the metal back-attached phosphor screen, which is formed according to claim 2 on an inner surface of a face plate.

9. An image display unit, comprising the metal back-attached phosphor screen, which is formed according to claim 3 on an inner surface of a face plate.

10. An image display unit, comprising the metal back-attached phosphor screen, which is formed according to claim 4 on an inner surface of a face plate.

11. An image display unit, comprising the metal back-attached phosphor screen, which is formed according to claim 5 on an inner surface of a face plate.

12. An image display unit comprising an envelop having a face plate and a rear plate which is disposed to oppose the face plate, multiple electron emission elements formed on the rear plate, and a phosphor screen formed on the face plate to oppose the rear plate so to emit light by an electron beam emitted from the electron emission elements, wherein the phosphor screen is the metal back-attached phosphor screen formed according to claim 2.

13. An image display unit comprising an envelop having a face plate and a rear plate which is disposed to oppose the face plate, multiple electron emission elements formed on the rear plate, and a phosphor screen formed on the face plate to oppose the rear plate so to emit light by an electron beam emitted from the electron emission elements, wherein the phosphor screen is the metal back-attached phosphor screen formed according to claim 3.

14. An image display unit comprising an envelop having a face plate and a rear plate which is disposed to oppose the face plate, multiple electron emission elements formed on the rear plate, and a phosphor screen formed on the face plate to oppose the rear plate so to emit light by an electron beam emitted from the electron emission elements, wherein the phosphor screen is the metal back-attached phosphor screen formed according to claim 4.

15. An image display unit comprising an envelop having a face plate and a rear plate which is disposed to oppose the face plate, multiple electron emission elements formed on the rear plate, and a phosphor screen formed on the face plate to oppose the rear plate so to emit light by an electron beam emitted from the electron emission elements, wherein the phosphor screen is the metal back-attached phosphor screen formed according to claim 5.

* * * * *